US007810673B2

(12) United States Patent
Lancesseur et al.

(10) Patent No.: US 7,810,673 B2
(45) Date of Patent: Oct. 12, 2010

(54) DEVICE FOR THE SINGLE-UNIT DISPENSING OF SHAPED OBJECTS, SUCH AS PHARMACEUTICAL TABLETS

(75) Inventors: Didier Lancesseur, Boulogne (FR); Bruno Herrbach, Morsang sur orge (FR); Sebastien Brogly, Geovreissiat (FR)

(73) Assignee: Airsec, Choisy le Roi (FR)

( * ) Notice: Subject to any disclaimer, the term of this patent is extended or adjusted under 35 U.S.C. 154(b) by 726 days.

(21) Appl. No.: 10/594,830

(22) PCT Filed: Mar. 30, 2005

(86) PCT No.: PCT/FR2005/000763

§ 371 (c)(1),
(2), (4) Date: Jul. 12, 2007

(87) PCT Pub. No.: WO2005/095227

PCT Pub. Date: Oct. 13, 2005

(65) Prior Publication Data

US 2008/0041875 A1 Feb. 21, 2008

(30) Foreign Application Priority Data

Mar. 30, 2004 (FR) ..... 04 03270

(51) Int. Cl.
*B65H 3/00* (2006.01)

(52) U.S. Cl. ..... 221/265; 221/263; 221/264; 221/151; 221/154

(58) Field of Classification Search ..... 221/263, 221/264, 265, 154, 203, 228, 208, 224, 225, 221/226, 227, 151; 206/533
See application file for complete search history.

(56) References Cited

U.S. PATENT DOCUMENTS 2,173,046 A 9/1939 Smith (Continued)

FOREIGN PATENT DOCUMENTS

FR 2624106 A1 6/1989

(Continued)

OTHER PUBLICATIONS

Office Action dated Feb. 20, 2009 with respect to U.S. Appl. No. 10/547,483.

(Continued)

*Primary Examiner*—Gene Crawford
*Assistant Examiner*—Timothy R Waggoner
(74) *Attorney, Agent, or Firm*—Scott R. Cox

(57) ABSTRACT

One end of the device is connected to a container in which the loose objects are stored, and optionally the other end connected to a cap for receiving the dispensed objects. The inventive device comprises a female and a male parts arranged coaxially. The female part is fixed and is used to collect, organize, and move the objects, and to store the same in a waiting line in one or more chute, while the male part is rotatable and is used to effect a single-unit removal of the objects to be dispensed by means of rotation in one direction of the other.

30 Claims, 7 Drawing Sheets

U.S. PATENT DOCUMENTS

| | | | | |
|---|---|---|---|---|
| 2,918,167 | A | 12/1959 | Lowen | |
| 3,435,988 | A | 4/1969 | Jonas et al. | |
| 3,517,855 | A | 6/1970 | Hillis | |
| 3,581,934 | A | 6/1971 | Sciascia | |
| 3,921,851 | A * | 11/1975 | Nilson | 221/265 |
| 4,228,920 | A | 10/1980 | Burton | |
| 4,240,564 | A | 12/1980 | Pritchard | |
| 4,266,690 | A | 5/1981 | Holmes et al. | |
| 4,782,981 | A | 11/1988 | Schuster | |
| 5,505,308 | A | 4/1996 | Elkmeier et al. | |
| 5,736,616 | A | 4/1998 | Ching et al. | |
| 5,788,064 | A | 8/1998 | Sacherer et al. | |
| 5,791,515 | A * | 8/1998 | Khan et al. | 221/265 |
| 6,334,974 | B1 | 1/2002 | Chen | |
| 6,497,845 | B1 | 12/2002 | Sacherer | |
| 2003/0010668 | A1 | 1/2003 | Taskis et al. | |
| 2006/0169603 | A1 | 8/2006 | Lancesseur et al. | |

FOREIGN PATENT DOCUMENTS

| | | | |
|---|---|---|---|
| FR | 2709475 | A3 | 3/1995 |
| GB | 539891 | | 9/1941 |
| GB | 1074165 | | 6/1967 |
| GB | 2210603 | A | 6/1989 |
| JP | 9315455 | | 12/1997 |
| JP | 2003118758 | A | 4/2003 |
| WO | WO9409084 | A1 | 4/1994 |
| WO | WO9528338 | A1 | 10/1995 |
| WO | WO9851758 | A1 | 11/1998 |
| WO | WO9948963 | A2 | 9/1999 |
| WO | WO2004024593 | A1 | 3/2004 |
| WO | WO2006040019 | A1 | 4/2006 |

OTHER PUBLICATIONS

Office Action dated Jun. 11, 2010 with respect to U.S. Appl. No. 11/751,226.

* cited by examiner

DEVICE FOR THE SINGLE-UNIT DISPENSING OF SHAPED OBJECTS, SUCH AS PHARMACEUTICAL TABLETS

FIELD OF THE INVENTION

The invention relates to a device for singly dispensing shaped objects such as pharmaceutical tablets, the dispensing of which is controlled by a partial rotating movement in either direction of part of the device, each partial rotation in either direction causing a shaped object to be released.

More specifically, the invention relates to a device for dispensing shaped objects such as, for example, pharmaceutical tablets, consisting of two coaxial parts which mate with each other,

- the female-type fixed part which forms the upstream part for entry into the device of the shaped objects packaged in bulk for dispensing singly, which comprises means for collecting, organising and gravity-organised movement of the objects to be dispensed in a free space created for this purpose, storage in a queue in two columns of stacked objects originating from the free space for orientation and organised movement of the objects, for releasing them singly,
- the other, male-type, moving part which performs partial alternating rotations about the common axis of the two parts and constitutes the lower part for discharge from the device of the singly dispensed shaped objects, this male part being provided with means for:
- allowing its limited rotation in both directions,
- organising the orientation and movement of the bulk objects to be dispensed in the free space created for this purpose, then the storage in a queue of stacked objects originating from the free orientation and movement space,
- delivering the stacked objects stored in an organised queue singly through an exit orifice by partial and alternate rotation of said moving part.

Finally, the invention relates to a closed unit for packaging and dispensing shaped objects singly that comprises, in sequence, a container in the shape of a tubular casing that is open at one of its ends for bulk packaging of the objects to be dispensed singly, the device for dispensing the objects to be dispensed singly, mounted by its female part on the opening in the tubular casing, and a cap which is mounted on the male part of the device, able to make the moving male part of said device partially rotate in either direction, and cause the picking out from the tubular casing then the dispensing singly by the device and finally the receipt of the dispensed shaped object in the cap.

The shaped objects to be dispensed using the device according to the invention may be sensitive to gaseous pollutants present in the ambient air within their packaging container.

Therefore, the tubular casing of the closed unit for packaging and dispensing said objects singly may include means containing one or more gaseous pollutant treatment agents for the rapid treatment of the ambient gaseous atmosphere by removing the gaseous pollutants from the sensitive objects packaged in said casing.

The following are therefore defined in the entire description of the subject of the invention:

- The shaped objects which are packaged in bulk in a container, for dispensing singly using the dispensing device of the invention, which may be sensitive to gaseous pollutants in the ambient atmosphere and may be made in shapes as varied as tablets or pills, hard capsules, soft capsules of round or polygonal section, spherical or other granules prepared in particular in the pharmaceutical, food or other industries.
- The gaseous pollutants which may be present in the ambient atmosphere of the packaging containers for the shaped objects and may, for example, be water vapour, oxygen ($O_2$), ammonia ($NH_3$), alcohols, aldehydes, ketones, sulphur dioxide ($SO_2$), hydrogen sulphide ($H_2S$), thiols, alkenes including in particular ethylene, acetylene hydrocarbons, carbon dioxide ($CO_2$), carbon monoxide (CO), nitrogen dioxide ($NO_2$), alkanes including in particular methane ($CH_4$), halogens including in particular fluorine, bacteria suspended in the ambient air and others.

Therefore and according to these definitions:

- The shaped objects, which may be sensitive to pollutants such as those specified above, to be packaged and dispensed singly are generally medicinal products, more particularly effervescent medicinal products, which it is desirable to protect so that their reactive efficacy is not impaired by a reaction with at least one of the pollutants and/or so that their physical integrity is maintained over time and so that, for example, a change in their mechanical cohesion is avoided.

For obvious reasons, in particular hygiene, but also in order to avoid any physical deterioration and thus improve the shelf life of the shaped objects to be dispensed, which are potentially sensitive to pollutants present in the ambient air, said objects are placed in containers equipped with the device for dispensing singly and having means for preventing potential physicochemical attacks resulting from the level of concentration of the gaseous pollutants, but also protecting them from light, in particular UV rays or else protecting them from deterioration due to mechanical effects such as impacts.

PRIOR ART

Establishment of the prior art reveals the existence of devices for singly dispensing shaped objects such as pharmaceutical tablets, these devices consisting of at least two coaxial cylindrical parts which mate with one another, one being fixed and the other rotatable about the common axis.

The devices for dispensing shaped objects singly are connected or made to connect, by mechanical assembly, to containers for bulk packaging of said objects, release of the objects to be dispensed singly being effected by gravity, i.e. by inverting the unit formed by the packaging container and the dispensing device, then by rotating the moving part of the dispensing device.

These known dispensing devices are formed:

- by a part for efficiently organising the bulk shaped objects and putting them in a physical position that facilitates their removal singly
- by at least one other part for picking out objects singly and removing the single picked out object from the dispensing device.

All these devices and their means for organising, picking out and singly dispensing shaped objects are formed from thermoplastic polymers by known plastics processing techniques.

These devices may be distinguished from each other by the architecture that is specific to each of them, using:

- means for changing the state of the objects to be dispensed from a disorganised bulk packaging state to an organised state, by arranging said objects in a given sequence to make it easier to pick them out singly, and means for picking out said arranged objects singly and dispensing said picked out objects.

According to a first type of device for dispensing bulk packaged shaped objects singly, this type of device is composed of, in the sequence of travel of the shaped objects to be dispensed, a first mechanical part in contact with the bulk packaged shaped objects, provided with a means for guiding said bulk objects and classifying them horizontally, and another mechanical part provided with means for picking out from the horizontal single-unit classification in the first part, for picking out and dispensing a shaped object, one of the mechanical parts being fixed and the other rotatable.

A document (U.S. Pat. No. 4,782,981) describes a device of this type for dispensing bulk packaged shaped objects singly, this device, which is an integral part of a unit for the bulk packaging of shaped objects and the dispensing singly of such objects, comprising three coaxial parts:

an upper fixed part, which is of the female type downstream, formed by a cylindrical casing that constitutes a chamber for packaging the bulk objects to be dispensed, a median part, which is of the male type upstream and of the female type downstream, rotates about the common axis, and mates with the downstream opening of the fixed upper part. This median part is formed by a cylindrical plate equipped with:

cylindrical orifices on its periphery which pass right across it and are organised in a circular alignment, these orifices each being intended to receive an object that is to be dispensed singly and originates from the bulk packaging of said objects in its central part which is perforated, a guide formed by a truncated cone shaped hollowed surface, open on the side of the perforated plate at the centre but closed at the other end, with the ability to guide the bulk stream of objects to be dispensed towards the cylindrical orifices.

a lower male-type fixed part, which mates with the downstream face of the median part, and is also a cylindrical plate equipped in its central part with a truncated cone that mates with the hollowed truncated cone shaped surface of the median part and at its periphery with a notch having a similar diameter to that of the cylindrical orifices in the median part, this notch being made congruent, by rotation of the median part, with each cylindrical orifice of the median part in turn and receiving the single object present in each cylindrical orifice and delivering it singly from the device.

This type of device for dispensing shaped objects to be dispensed singly has certain disadvantages that it is desirable to eliminate or reduce to facilitate use of the device and for the physical integrity of the objects dispensed singly by the device.

In fact, it appears that this type of device:

does not allow for predetermined controlled travel of the bulk packaged objects to the cylindrical orifices in the median part of the device, each intended to receive a single object to dispense. When the device is inverted to enable it to function as a dispenser, all the bulk packaged objects come into contact with the cylindrical orifices where a disorganised accumulation of a plurality of objects at the inlet to each orifice is produced.

can cause damage to said objects by mechanical handling of the bulk objects when congruence is reached between one of the cylindrical orifices of the median part and the notch on the lower part outside the device, when the median part is rotated, as the object present in each cylindrical orifice initially in contact with other bulk objects is separated from them by a fixed blade, placed in the axis of the notch, which sweeps excess objects that have accumulated at the inlet of each orifice and blocks the entry to this orifice when it becomes congruent.

does not allow rapid dispensing singly of the objects to be dispensed as, due to its position, it is not easy to manually rotate the median part, inserted as it is between the upper and lower part, leaving only the notched crown accessible.

does not guarantee the complete physicochemical integrity of the objects to be dispensed that are packaged in bulk in a packaging casing, said casing having no means for treating the gaseous atmosphere present in the packaging chamber which can contain gaseous pollutants, in particular water vapour.

According to another type of device for dispensing shaped objects singly, this other type, in the sequence of travel of the shaped objects to be dispensed, comprises two coaxial parts:

the first mechanical part being in contact with the bulk packaged shaped objects and possessing means for organising the guidance then the vertical peripheral classification singly of said shaped objects originating from the bulk packaging, the second mechanical part downstream of the first part being equipped with means for picking out a single unit from the unitary peripheral vertical unit classification of the shaped objects to be dispensed from the first part and means for dispensing the picked out shaped objects singly, one of the parts being fixed and the other rotatable.

A document (U.S. Pat. No. 4,228,920) describes a device of this type for dispensing bulk packaged pharmaceutical tablets singly. This device which is an integral part of a unit for packaging bulk tablets and dispensing them singly consists of two coaxial parts which are, in the direction of travel of the shaped objects to be dispensed singly:

an upper male-type fixed part composed of an external cylindrical casing and coaxially of an internal mechanical part, which is generated by revolution and is cylindrical/truncated cone shaped when viewed in the upstream/downstream direction, the external and internal parts defining a peripheral annular free space therebetween. During inversion of the device for the use thereof, the free space, the distance between the walls of which is close to the thickness of the tablets, fills with said bulk packaged tablets, which, when they are arranged, form a peripheral layer, the thickness of which is the same as the tablets, formed by successive rows of tablets having only tangential contacts at their rim, these rows having a pseudo-sinusoidal appearance due to the presence of a travel ramp in the downstream part of the free space, this ramp having two regions at the top and two at the bottom for directing the tablets towards two single-unit storage compartments where they are be picked out internally and dispensed singly.

a female-type rotatable lower part composed of a cylindrical casing and a bottom equipped with two diametrically opposed exit orifices for the extraction of the tablets singly.

To bring about this extraction, the moving lower part is subjected to a rotating movement to create axial congruence between one of the compartments for storage of single tablets in the upper part and one of the two exit orifices, this congruence releasing at least one tablet, the compartment which is emptied of its tablet being blocked at the moment of axial congruence by one of the two top regions of the travel ramp and only able to receive another single tablet after clearance of the compartment by continuation of the rotating movement of the lower part.

The type of device for dispensing shaped objects singly:

- tends to organise travel of the objects packaged in bulk but the travel is poorly controlled as, because of the inversion movements in one direction then the other of the dispensing device, when used, all the free space created in the upper part completely fills with tablets then empties when the direction is reversed, thus increasing impacts between said tablets.
- does not allow rapid dispensing of the object to be dispensed, as the rotational angle of the lower part can be great, i.e. 360° when the lower part of the device comprises only an exit orifice and 180° when said part comprises two exit orifices.
- cannot allow the integrity of the objects to be dispensed, which are packaged in bulk in the packaging casing that seems to be deprived of means for treating the ambient gaseous atmosphere often containing gaseous pollutants, particularly water vapour which is harmful to the integrity of the shaped objects to be dispensed.

Therefore, it appears that none of the devices for dispensing shaped objects singly in the prior art have sufficient means for organising controlled travel, improved physical integrity and rapid dispensing singly of the shaped objects to be dispensed to fully satisfy the user of the device for dispensing singly.

OBJECTIVES OF THE INVENTION

Numerous objectives are consequently assigned to the device for dispensing shaped objects singly according to the invention, so that it can overcome the above-mentioned disadvantages and provide adapted and improved solutions compared to the various means used in devices for dispensing shaped objects described in the prior art.

Amongst the most important objectives assigned to the device for dispensing singly according to the invention for shaped products packaged in bulk, the following means are mentioned which, in combination, provide:

- Good organisation of the travel of the shaped objects from the region where they are packaged in bulk to the region where they are dispensed singly, by making them change from a disordered condition to an ordered condition when the device is used to limit the impact of the shaped objects against each other caused by handling of the device.
- An initial selective orientation of the bulk shaped objects and standby storage of the oriented shaped objects in a region created for this purpose.
- An organised queue of shaped objects, oriented by the creation of stacks of shaped singly oriented objects into columns.
- The individual picking out of a shaped object to be dispensed from one of the stacked columns by rotation over a given angle in one direction and from another stacked column by rotation over the same angle in the opposite direction to pick out another individual object.
- Replacement in each stacked column of each shaped object picked out through the opening in the upstream end of the column concerned.
- A means for treating gaseous pollutants, particularly water vapour, present in the container for removing internal pollution that is formed and for preventing packaged shaped objects that are sensitive to gaseous pollutants from absorbing and/or reacting in part with said pollutants in order to keep the level of gaseous pollutants inside the container at a low and relatively constant level and to protect the packaged products that are sensitive to these pollutants as effectively as possible.

SUMMARY OF THE INVENTION

All the above-mentioned objectives may be achieved by the device for dispensing shaped objects singly, which is a device that can be mounted by its upstream face on a container for packing said bulk objects, said container being able or to provide or not provide a purification treatment for the ambient air therein to protect said objects if they are sensitive to gaseous pollutants, and that can be closed by a cap placed on the downstream face.

According to the invention, the device for dispensing shaped objects singly which can be connected by one of its ends to a container for the bulk packaging of shaped objects to be dispensed and optionally by the other end to a cap for receiving the singly dispensed objects, consists of two parts which mate coaxially with each other, one, the female part, being fixed and the other, the male part, being rotatable, and is characterised in that, in the sequence of travel of the objects to be dispensed singly from their bulk packaging region, a) the fixed female part which constitutes the upstream part for entry into the device of the bulk objects to be dispensed comprises:

a1) a main external cylindrical casing which is open at its upstream end and downstream end, a2) an internal casing, which is coaxial with the external casing, closed at its upstream part and open at its downstream part, of which the distance from the external casing is at least equal to the smallest dimension of the object to be dispensed to create a free space for the orientation and organised movement of said objects from upstream to downstream, a3) a first plane, which is close to the upstream end, connects the coaxial external casing and internal casing, perpendicularly to said axis, is shaped as a circular sector of angle $\alpha$, is provided with an opening shaped as an arc of a circle, and leaves the free space for orientation and organised movement clear, a4) a second plane, which is placed between the first plane and the downstream end, connects the coaxial external casing and internal casing perpendicularly to said axis, is shaped as a circular sector of angle $\beta$ provided with at least one opening dimensioned for the passage downstream singly of the objects present in the free space for orientation and organised movement, a5) between the second plane and the downstream end of the female part, at least one chute mounted on the at least one opening in the second plane, to allow storage in a queue of stacked objects to be dispensed, which originate from the free space for the orientation and organised movement, this at least one chute being delimited by the coaxial external casing and internal casing and by two planar lateral walls connecting said casings and extending to the downstream end of said female part, the at least one chute being provided at its downstream end with an opening dimensioned for the passage of a single object to be dispensed, b) the male rotating part which constitutes the downstream part for discharge of the dispensed objects from the device comprises:

b1) a base platform in the shape of a circular disk which forms a stop for the main external cylindrical casing of the female part, this platform being equipped with an opening dimensioned for the passage of an object delivered by the at least one chute.

b2) a casing, coaxial with the base platform to which it is connected, having substantially the shape of the internal casing of the female part of the device, in which it inserts itself to make the male part rotate relative to the female part of the device.

b3) a means for guidance in rotation connected to and perpendicular to the base platform, the free end of which is intended to be inserted in the opening shaped as an arc of a circle of the first plane of the female part, b4) a crown segment, mounted on the means for guidance in rotation, which moves freely, when the male part of the device rotates, between the two planes of the female part of the device and which blocks the inlet opening of the at least one chute, at least partially and at the end of its travel, in at least one direction of rotation of the male part, b5) a guide means for the object to be dispensed placed in the axis of the dimensioned opening in the base platform on the external wall of the casing coaxial with the platform of the male part.

DETAILED DESCRIPTION OF THE INVENTION

The various objectives assigned to the subject of the invention are a result of the deficiencies displayed by the devices for dispensing shaped objects singly, described in the prior art.

The deficiencies ascertained in the prior art devices for dispensing shaped objects singly constitute, by their juxtaposition, a problem that simultaneously relates to: the lack of organisation in the travel of the objects to be dispensed, their orientation, the means for picking them out from a standby region, the absence of treatment of gaseous pollutants; all these deficiencies being able to cause irreversible chemical and mechanical damage to the shaped objects to be dispensed singly.

According to the invention, the device for dispensing shaped objects singly is very different from the prior art due to the fact that its new architecture provides it with the means for solving the problem raised by the deficiencies noticed in the prior art dispensing devices.

The device according to the invention for dispensing shaped objects singly is made up of two coaxial parts, a female part and a male part.

The female part of the device according to the invention constitutes, in the sequence of travel of the shaped objects to be dispensed, the face for entry into the device of a stream of objects to change from a disordered into an ordered state.

This female part is formed by an external cylindrical casing that is open at both ends, equipped on its external face with a ring connected to said casing and forming a stop when this female part of the dispensing device is mounted on the opening of a tubular casing of a bulk packaging container for shaped objects to be dispensed, and provided with a cap for receiving the dispensed shaped object on its exit or downstream face.

Inside this external cylindrical casing there is another casing, coaxial with the first, which is closed at its upstream end and open at its downstream end. This coaxial internal casing is a casing which is generated by geometric revolution and is of the cylindrical, cylindrical/truncated cone shaped, cylindrical/conical, truncated cone shaped, conical or parabolic type. The upstream part of this coaxial internal casing can be the region where the section of said casing is reduced, and in this case it can be of a truncated cone shaped, conical, hemispherical or parabolic type.

The section of this internal coaxial casing, which can change in its geometry, is such that the free annular space created between the coaxial external casing and internal casing allows travel organised by gravity for moving the shaped objects from the region they where are packaged in bulk to the region they are dispensed singly, this organised travel passing through stages for collecting the bulk shaped objects and selectively orienting these objects.

To arrange the collection and selective orientation of the shaped objects to be dispensed by gravity, the free space created between coaxial external casing and internal casing achieves a minimum thickness at its part furthest downstream but slightly greater than the smallest dimension of the object to be dispensed, forcing said object to place itself in a position of selective orientation to enable it to continue on its subsequent travel from upstream to downstream.

Inside the female part and connecting the coaxial external casing and internal casing a first plane has been developed, close to the upstream end of said female part and perpendicular to the axis of the casings. This first plane is shaped as a circular sector, of which the angle $\alpha$ at the top has a value in degrees which is a resultant of the diameter of the shaped objects to be dispensed and the diameter of the female part.

This first plane, by virtue of its circular sector shape, creates a means for controlling the rate of flow and orientation of the stream of shaped objects to be dispensed and adheres to the free space for orientation and organised movement between the two coaxial casings into which said stream of shaped objects is directed and channelled.

A second plane, perpendicular to the axis of the coaxial casings and connecting them to each other, is situated inside the female part and placed between the first plane and the downstream end of said female part. This second plane is also shaped as a circular sector, having an angle $\beta$ at the top of which the value in degrees is a resultant of the values of the diameters of the shaped objects to be dispensed and the female part. This second circular sector of angle $\beta$ occupies a position opposite the first circular sector of angle $\alpha$.

This second plane is equipped at its periphery and close to the external casing with at least one opening, of which the section is dimensioned to allow the passage downstream singly of the shaped objects which are oriented in the space for orientation and organised movement: this section of the at least one opening is greater than the smallest section of the objects but such that two shaped objects to be dispensed cannot pass through together and preferably very slightly greater than the smallest section of the shaped objects to be dispensed.

If the second plane has two openings at the periphery and close to the external casing, these two openings are mutually spaced by an angle $\gamma$ delimited by its two sides passing through the centre of symmetry of each of these openings: the angle $\gamma$ may vary between a value of approximately 0° when the two openings are juxtaposed up to 180 degrees when the two openings are diametrically opposed, this range of variation being the same regardless of the direction of rotation of the male part in the female part.

Once the two planes in the shape of a circular sector, spaced from each other along the axis of the female part, have their vertex angles $\alpha$ and $\beta$ opposite each other, there is a constant relationship between these two angles so that the total of angles $\alpha+\beta$ is at most 360° C.

The combination of these two offset planes, each shaped as an opposing circular sector and connected to the coaxial external casing and internal casing, creates organised travel for the selective orientation of the objects according to their smallest dimension and their path towards the at least one opening in the second plane.

Inside the female part, and between the second plane and the downstream end of said female part, there is at least one chute mounted on the at least one opening in the second plane and downstream of said plane, this at least one chute fulfilling the function of packaging in a queue the singly stacked shaped objects originating from the free space for orientation and organised movement.

This at least one chute, which is open at each of its ends, is delimited at its periphery by the coaxial external and internal casings and by two planar lateral walls connecting said coaxial casings and extending as far as the downstream end of said female part, these two walls being able to be parallel or concurrent with each other from upstream to downstream of the at least one chute.

Therefore, the section of the at least one chute may be:

substantially the same as the section of the at least one opening present in the second plane, so that said section is invariable along the whole length of the at least one chute and very slightly greater than the smallest section of the shaped objects to be dispensed, this smallest section being the one used for the orientation and organised movement of the shaped objects to be dispensed, during their travel in the dispensing device according to the invention.

or else different along the whole length of the at least one chute, said section decreasing, in particular homothetically, from upstream to downstream of the at least one chute, and becoming, at the downstream exit, a section that is very slightly greater than the smallest section of the shaped objects to be dispensed.

Inside the at least one chute, the shaped objects to be dispensed singly are stacked there according to their smallest section to be released singly when the device is used, at the downstream end of the at least one chute.

The opposing planar lateral walls, as well as the walls formed by the coaxial internal casing may be restricted in their downstream length in the direction of travel of the shaped objects to be dispensed.

The male part of the device according to the invention constitutes, in the sequence of travel of the shaped objects to be dispensed, the face for single discharge, or downstream face, of the device, for objects of which the stream has changed from a disordered to an ordered state.

This male part according to the invention is formed by a base platform in the shape of a circular disk acting as a stop for the external main cylindrical casing of the female part when the two parts that constitute the device according to the invention are assembled.

Said platform is provided with an opening dimensioned for the passage of a shaped object released singly through the at least one chute when said opening is made congruent by rotation with the open downstream end of the at least one chute.

This male part according to the invention is also formed by a casing coaxial with the base platform to which it is connected, which casing is closed at it upstream end and open at its downstream end and has substantially the geometry of the internal casing of the female part of the device in which it inserts itself coaxially to enable the male part to rotate relative to the female part.

This casing that is coaxial with the platform is a casing having a geometry generated by revolution that is cylindrical, cylindrical/conical, truncated cone shaped, conical or parabolic, the upstream part of this casing being the one with a section that may be reduced.

This male part according to the invention comprises a guide means connected to the base platform and mounted vertically on said platform.

The free end of the guide means is inserted into the opening shaped as an arc of a circle in the first plane of the female part and its purpose is:

to facilitate the rotation of the male part when it is in place in the female part.

to restrict the angle of rotation in both directions by means of a stop at each end of the opening shaped as the arc of a circle in the first plane of the female part, so that the opening in the platform is congruent with the downstream end of the at least one chute.

with regard to the part that emerges from the opening that is shaped as an arc of a circle in the first plane of the female part, to agitate the shaped objects packaged in bulk and to facilitate their orientation and movement in the upstream inlet part of the device according to the invention.

The guide means, connected to the base platform of the male part, is provided with a crown segment which moves between the two planes of the female part of the device when the male part is driven by a rotating movement. This crown segment may be bevelled at each of its ends, and this assists the local agitation of the shaped objects to be dispensed, and selects one of the objects that it guides towards the upstream opening in the at least one chute depending on the direction of rotation of the male part.

When said male part is caused to rotate in either direction and comes to the end of its travel, the crown segment blocks, at least partially and in one direction of rotation of the male part, the inlet orifice of the at least one chute.

Consequently, when the user turns the male part in one direction and when said male part reaches the end of its travel, the crown segment blocks, at least partially, the inlet orifice of the at least one chute and when the user turns the male part in the opposite direction, and when said male part reaches the end of its travel, the crown segment opens the inlet orifice of the at least one chute.

If the device has two chutes the crown segment, mounted on the guide means which moves freely during rotation of the male part between the two planes of the female part, blocks the upstream opening in the chutes, at least partially and alternately at the end of its travel.

Finally, the male part according to the invention comprises a guide means for the objects to be dispensed singly, this guide means being connected to the external wall of the casing coaxial with the platform, in the axis of the dimensioned orifice of the platform to grip and eject a single object that originates from the at least one chute, depending on the direction of rotation used for the male part. Said guide means may have a semi-polygonal, semicircular or semi-elliptical cross section.

According to the invention, the restricted range of the angle of rotation of the male part, from one end stop to the other end stop, is between a value of approximately 0 degrees and 180 degrees, i.e. this angle has the value substantially of the angle $\gamma$.

The device for dispensing shaped objects singly according to the invention is generally connected at the top to a packaging container for said objects stored in bulk which feeds the device for dispensing objects to be dispensed and, at the bottom, to a cap for receiving the singly dispensed shaped object.

The invention also relates to a closed unit for packaging and dispensing shaped objects singly which comprises a container formed by a casing that is open at one if its ends for packaging the bulk objects to be dispensed, the device for dispensing the objects to be dispensed singly being mounted by its female part on the opening in the tubular casing, and a cap mounted on the male part of the device, said cap being able to rotate the moving male part of said device partially in either direction and to cause the picking out of shaped objects to be dispensed from the casing then the dispensing thereof singly by the device and finally receipt of the dispensed shaped object in the cap.

However, the shaped objects to be dispensed singly using the device according to the invention may be sensitive to gaseous pollutants present in the ambient air within their packaging container. These above-mentioned gaseous pollutants which may be present in the ambient atmosphere of the packaging containers for the shaped objects could be, for example, water vapour, oxygen ($O_2$), ammonia ($NH_3$), alcohol, aldehydes, ketones, sulphur dioxide ($SO_2$), hydrogen sulphide ($H_2S$), thiols, alkenes including in particular ethylene, acetylene hydrocarbons, carbon dioxide ($CO_2$), carbon monoxide (CO), nitrogen dioxide ($NO_2$), alkanes including in particular methane ($CH_4$), halogens including in particular fluorine, bacteria suspended in the ambient air and others.

For this reason the closed unit for packaging and dispensing said objects singly may include treatment means containing one or more agents for treating gaseous pollutants to allow the rapid purification of the ambient gaseous atmosphere by removing said gaseous pollutants, in particular water vapour that is particularly harmful to the sensitive objects packaged in said casing.

To achieve this, appropriate recesses, situated in the tubular casing of the packaging container for the bulk objects to be dispensed and/or in the cap for receiving the singly dispensed shaped objects, may be made in the closed packaging and dispensing unit, in order to receive one or more agents for treating gaseous pollutants and to allow the removal thereof by rapid treatment of the ambient gaseous atmosphere. The specific position of these recesses is decisive for increasing the kinetics of elimination of gaseous pollutants, more particularly water vapour.

In the particular case of treating the water vapour present, so that the closed unit for packaging and dispensing shaped objects singly according to the invention has effective drying properties, the choice of drying agent is crucial.

According to the invention, the drying agent used in the closed unit for packaging and dispensing shaped objects singly is chosen from the group that consists of silica gels, molecular sieves and clays.

These closed drying units have internal drying means which may be present in the form of a covering, an insert or a part of the dispensing device, formed by a drying thermoplastic polymer composition. These drying agents are placed inside the containers on the internal surface of their bottom and/or on the internal surface of their lateral wall or else in a specific recess situated at the bottom of the containers and/or on the internal surface of the cap, if they are in a powdery form or else in the form of compacted pellets.

All these drying agents are put in separately or simultaneously to increase the efficacy of their drying action through a mass effect.

When treating gaseous pollutants other than water vapour, so that the closed unit for packaging and dispensing shaped objects singly according to the invention is also very effective with regard to said pollutants, known treatment agents that are appropriate for treating all pollutants are used in said unit:

- either mixed with the drying agent,
- or separately from the drying agent by creating open compartments in the appropriate recess, dividing said recess into sectors, enabling a plurality of treatment agents or mixtures of treatment agents that are compatible with each other to be received, or else in the form of compacted pellets prepared from the treatment mixture.

The dispensing device and the closed unit for packaging and dispensing shaped objects singly may be formed by plastics processing procedures using materials which are thermoplastic polymers and/or copolymers such as, for example, polyethylenes (PE), polypropylenes (PP), ethylene/propylene copolymers and mixtures thereof, polyamides (PA), polystyrenes (PS), acrylonitrile-butadiene-styrene copolymers (ABS), styrene acrylonitrile copolymers (SAN), polyvinylchorides (PVC), polycarbonates (PC), polymethyl methacrylate (PMMA), polyethyleneterephthalates (PET) used individually or mixed, depending on their compatibility.

At least one natural or synthetic thermoplastic elastomer may be associated with these polymers and/or copolymers to make the device and depending on the desired mechanical characteristics. The elastomer(s) used should preferably be chosen from the group consisting of elastomers of the natural rubber type or synthetic rubber type, in particular olefin-based rubbers, such as, for example, isobutylene/isoprene polymers, ethylene-vinyl acetate (EVA), ethylene-propylene (EPR), ethylene-propylene-diene (EPDM), ethylene-acrylic esters (EMA-EEA), fluoropolymers, diene rubbers, such as, for example, polybutadienes, butadiene-styrene copolymers (SBR), rubbers based on condensation products such as, for example, thermoplastic polyester and polyurethane rubbers, silicones, styrene rubbers, styrene-butadiene-styrene (SBS) and styrene-isoprene-styrene (SIS) and others.

According to the invention, the device for dispensing shaped objects singly, the tubular casing of the bulk packaging container and the cap for receiving the shaped object dispensed singly by the dispensing device may be produced from polymer materials with the same composition or from polymer materials with different compositions.

More generally, all the sides of the device for dispensing shaped objects singly according to the invention depend on the dimensions of the shaped objects to be dispensed.

A better understanding of the invention will be achieved by using the numbered description of the figures set out below, these figures simply being used to illustrate but not limit a device according to the invention.

Figure 1:
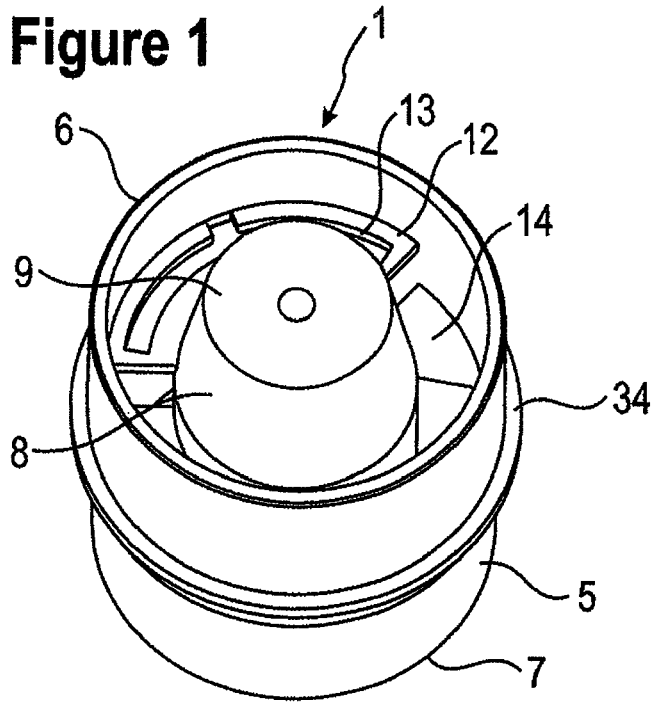
FIG. 1 is a perspective view of the female part of the device for dispensing shaped objects singly according to the invention, with a view of the upstream face or inlet face for the bulk objects, the longitudinal axis of which is almost vertical.

According to FIGS. 1 to 12, the device for dispensing shaped objects singly comprises a female part (1) and a male part (2).

Figure 2:
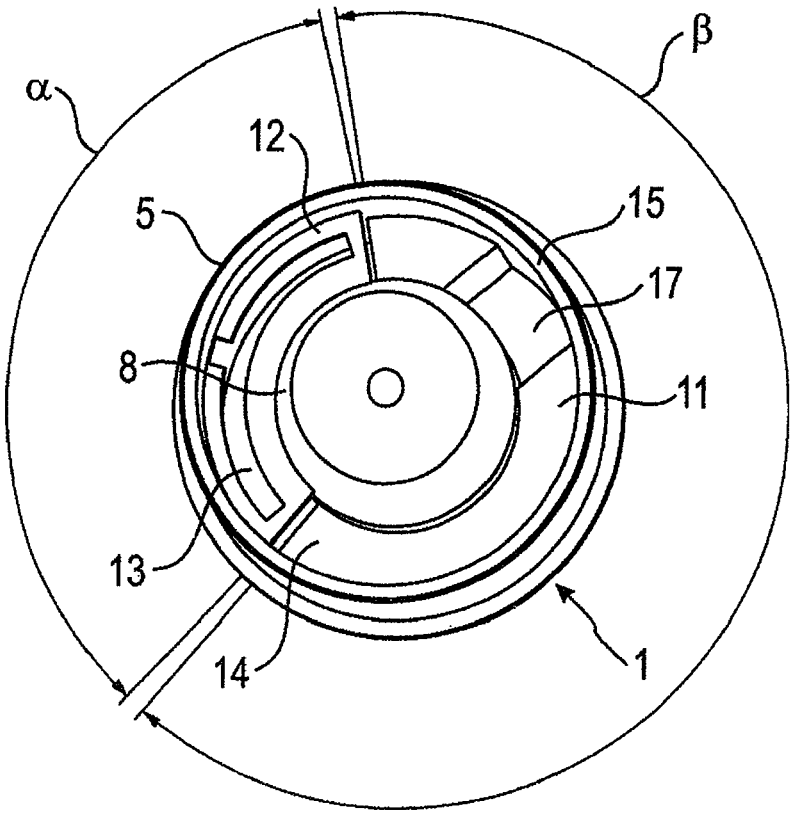
FIG. 2 is also a perspective view of the female part of the device for dispensing shaped objects singly according to the invention, when said female part has a single opening and a single chute in its second plane, with a view of the inlet face for the bulk objects, said FIG. 2 showing angles $\alpha$ and $\beta$.
Figure 3:
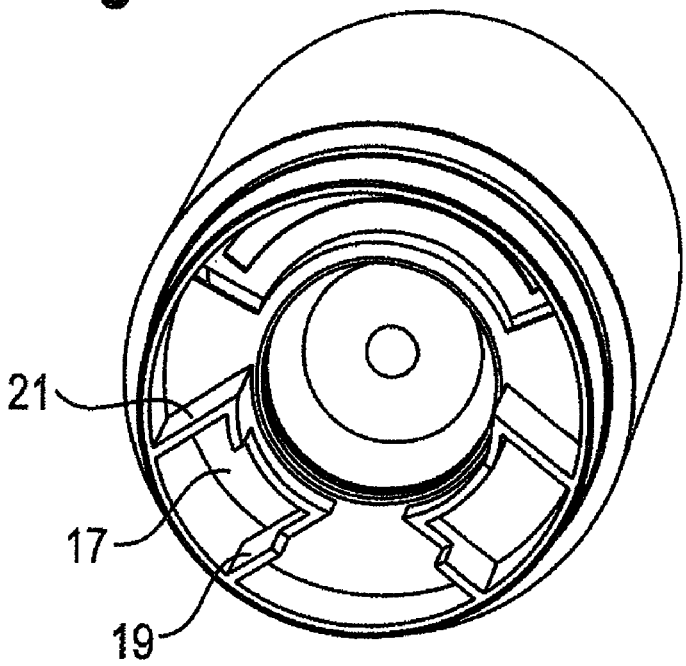
FIG. 3 is a perspective view of the female part of the device for dispensing shaped objects singly according to the invention, when said female part is provided with a single chute, with a view of the downstream face or the exit face for the objects.
Figure 4:
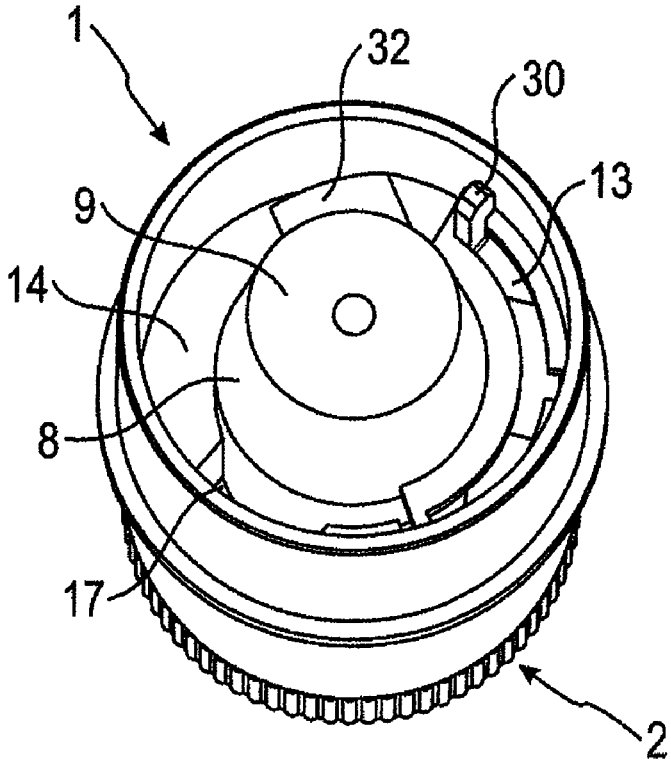
FIG. 4 is a perspective view of the device for dispensing singly according to the invention, when said female part is provided with a single chute, after assembly of the female and male parts, with a view of the inlet face for the bulk shaped objects.
Figure 5:
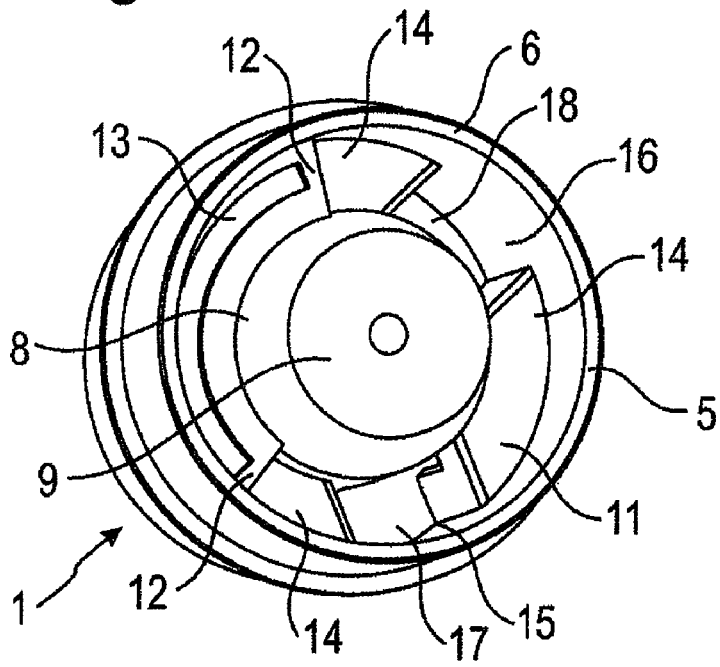
FIG. 5 is also a perspective view of the female part of the device for dispensing shaped objects singly according to the invention, when said female part is provided with two openings and two chutes in its second plane, with a view of the inlet face for the bulk objects, of which the longitudinal axis is almost horizontal.
Figure 6:
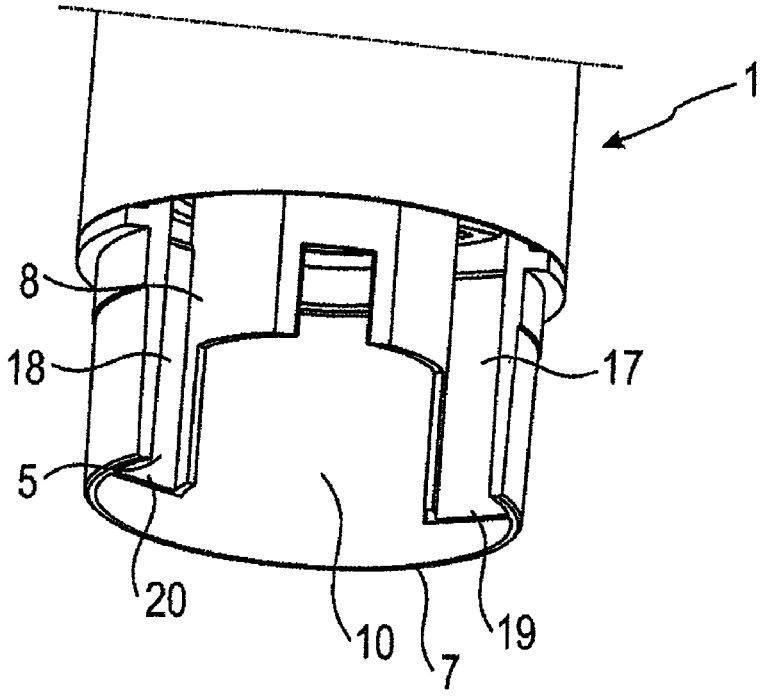
FIG. 6 is a cut-away perspective view of the female part of the device for dispensing shaped objects singly according to the invention, when said female part is provided with two chutes, with a view of the downstream face or the exit face for the objects which have been oriented and placed in an organised queue.
Figure 7:
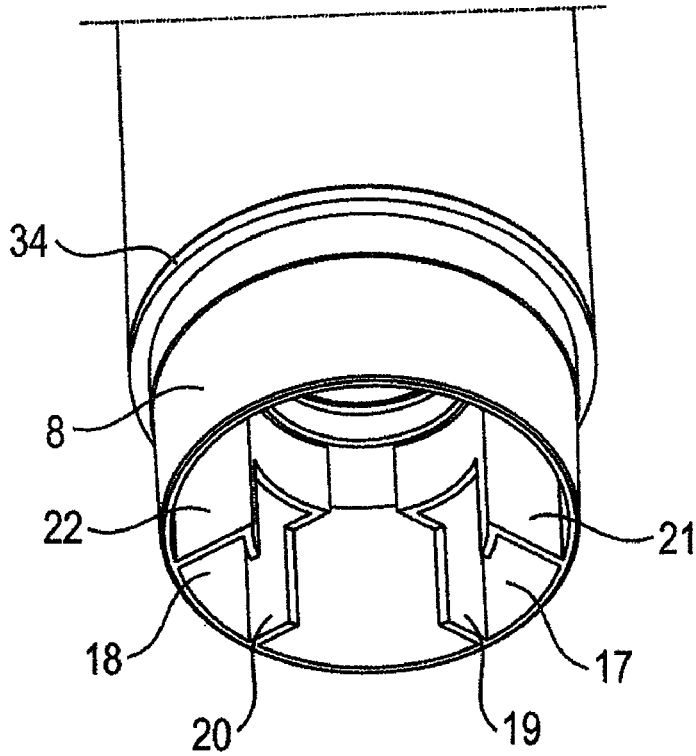
FIG. 7 is a perspective view of the female part of the device for dispensing shaped objects singly according to the invention, when said female part is provided with two chutes, with a view of the downstream face or the exit face for the objects which have been oriented and placed in the two chutes.

The female part (1) comprises in the sequence of travel of the objects to be dispensed singly from the region where they are packaged in bulk:

an external cylindrical casing (5), open at its upstream end (6) and downstream end (7).

an internal casing (8) in the form of a cylinder/truncated cone coaxial with the closed external cylindrical casing (5) at its upstream end (9) and open at its downstream end (10). The free space (11) created between the external casing (5) and internal casing (8), mutually spaced by a distance at least equal to the smallest dimension of the object to be dispensed, provides a space for orienting the bulk shaped objects and for the organised movement of the oriented shaped objects from upstream to downstream.

a first plane (12), which is close to the upstream end (6), connects the external casing (5) and internal casing (8), is placed perpendicularly to the common axis, has the shape of a circular sector of angle $\alpha$ of, for example, 120 degrees, and is provided with an opening in the shape of an arc of a circle (13), leaving the free space (11) clear from upstream to downstream.

a second plane (14), which is placed between the first plane (12) and the downstream end (7), and also connects the external (5) and internal (8) coaxial casings perpendicularly to the axis, in the shape of a circular sector of angle $\beta$ of, for example, 220 degrees, this second plane being provided with:

either a single opening (15), dimensioned for the passage of single shaped objects present in the free orientation and movement space (11) singly from upstream to downstream, according to FIGS. 2 to 4.

or two openings (15) and (16), dimensioned for the passage of shaped objects present in the free orientation and movement space (11) singly from upstream to downstream, according to FIGS. 5 to 7.

between the second plane (14) and the downstream end (7):

according to FIGS. 2 to 4, a single chute (17) mounted on a single opening (15) in the second plane (14), to allow storage in a queue of the objects to be dispensed that originate from the free space (11), this chute being delimited by the coaxial casings (5) and (8) and by two lateral walls (19, 21);

according to FIGS. 5 to 7, two chutes (17) and (18) mounted on the openings (15) and (16) in the second plane (14), to allow storage in a queue of the objects to be dispensed that originate from the free space (11), these two chutes being delimited by the coaxial casings (5) and (8) and by two lateral walls (19, 21) and (20, 22) of each of the two chutes.

FIG. 6, showing a device comprising two chutes according to the invention, shows the planar lateral walls (19) and (20) that are furthest apart and belong to the two chutes (17) and (18), whilst the lateral walls (21) and (22) that are the closest to each other and belong to the chutes (17) and (18) are not visible in said FIG. 6 due to it being a broken away perspective view, but are visible in FIG. 7.

Figure 8:
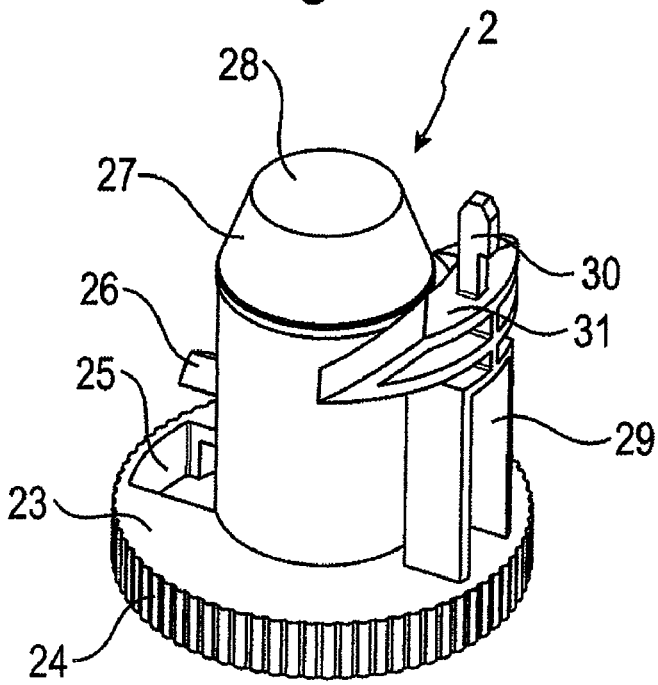
FIG. 8 is a perspective view of the male part of the device for dispensing shaped objects singly according to the invention, showing the means for guidance in rotation of the male part.
Figure 9:
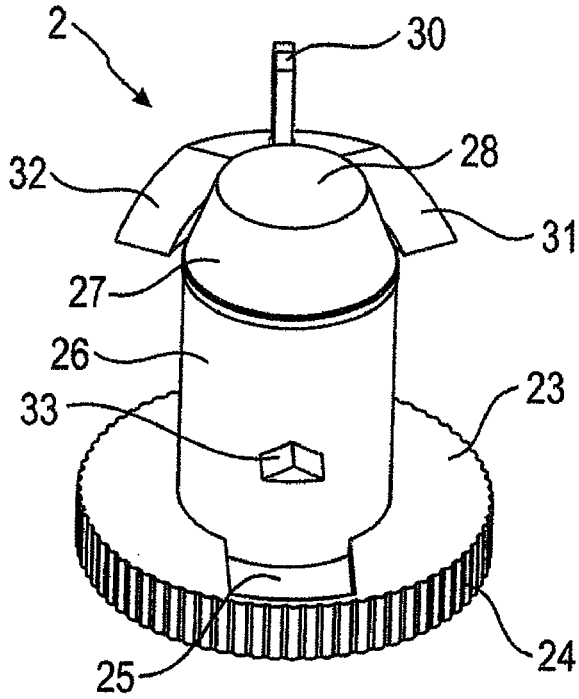
FIG. 9 is a perspective view of the male part of the device according to the invention, showing the guide means for the objects to be dispensed singly.
Figure 10:
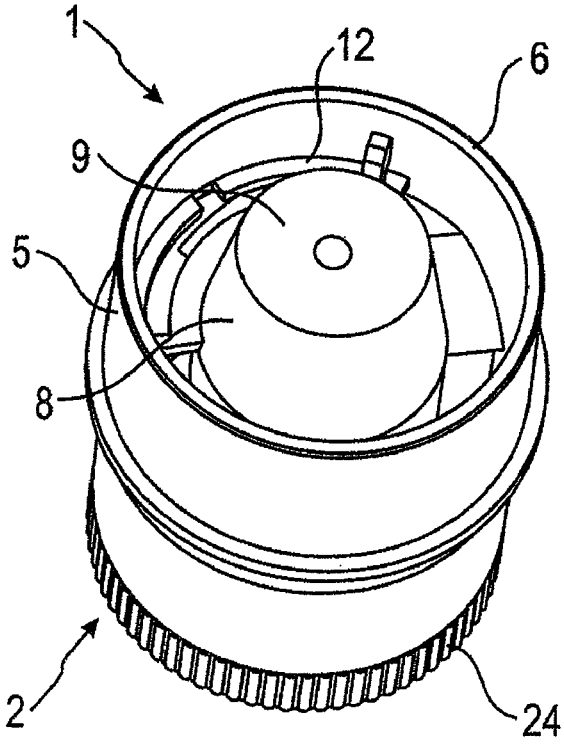
FIG. 10 is a perspective view of the device for dispensing singly according to the invention, after assembly of the female and male parts, with a view of the inlet face for the bulk shaped objects.
Figure 11:
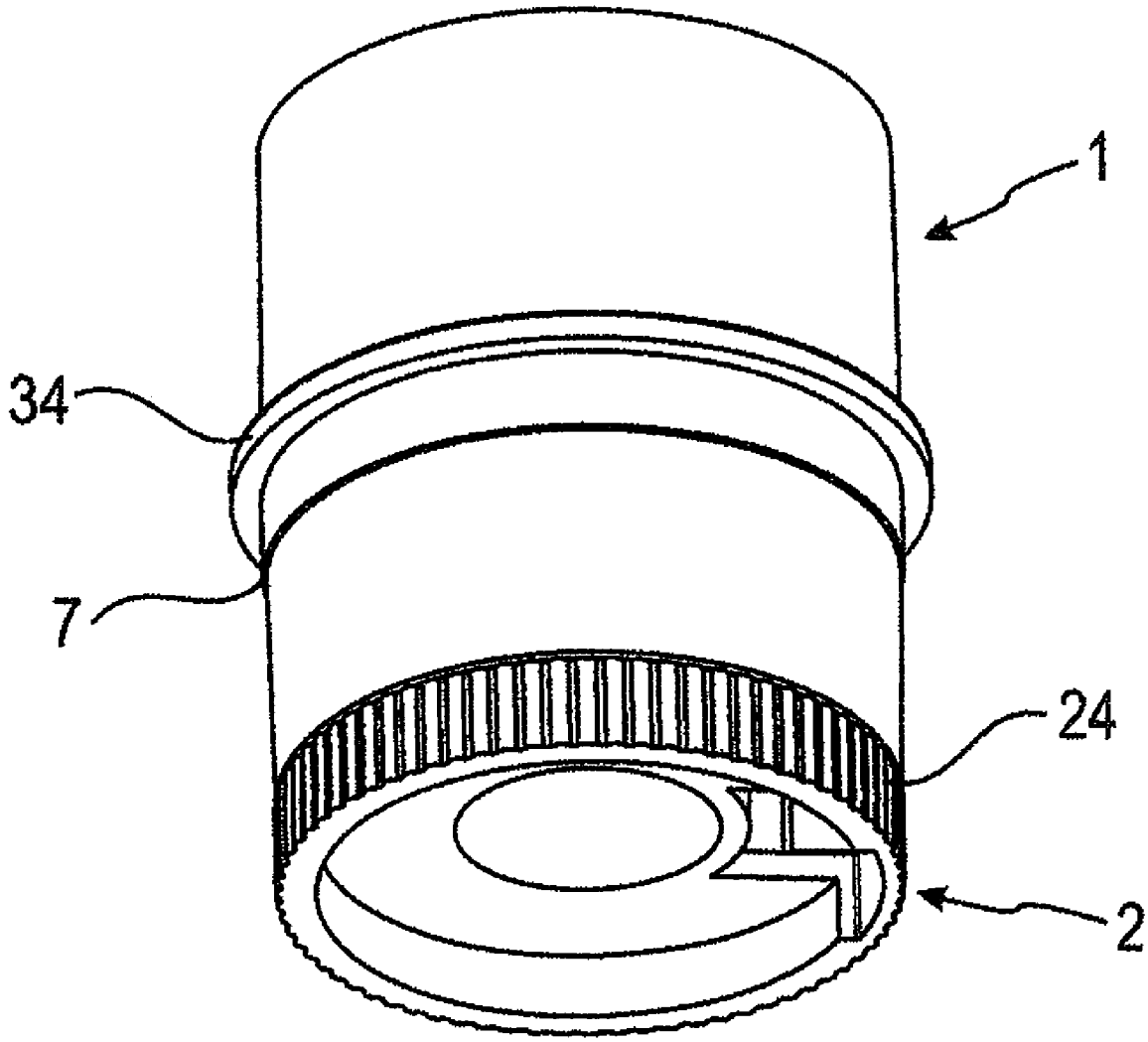
FIG. 11 is a perspective view of the device for dispensing singly according to the invention, after assembly of the female and male parts, with a view of exit face for discharging shaped objects singly.

According to FIGS. 8 and 9, the rotatable male part (2) of the dispensing device according to the invention is just as suitable if it has a single chute as it is if it has two chutes. This male part constitutes the downstream exit part for the singly dispensed shaped objects and comprises:

a base platform (23) in the shape of a circular disc, the periphery (24) of which is grooved, forming a stop for the external cylindrical casing (5), this platform being provided with an opening (25) dimensioned for the passage of an object delivered by the at least one chute (17) and/or (18) when said opening (25) is made congruent with either of the downstream exits of said at least one chute by rotation of the female part (2) in either direction.

a casing (26) which is coaxial with the platform (23) to which it is connected, is cylindrical/truncated cone-shaped (26-27), is closed at its upstream end (28) and, when the male part (2) is mated with the female part, is inserted in the internal cylindrical/truncated cone-shaped casing (8) of the female part (1).

This coaxial casing (26) constitutes the downstream part of one of the walls of the at least one chute (17) and/or (18).

a means for guidance in rotation (29) of the male part (2) mounted perpendicularly on the platform (23), the extreme part (30) of said guide means (29) being inserted when the female (1) and male (2) parts are fitted in the opening shaped as an arc of a circle (13), the ends of which constitute end of travel stops for the male part rotating in either direction. The extreme part (30) of the means for guidance in rotation (29) which emerges from the opening in the shape of an arc of a circle (13) constitutes a "stud" that is able to agitate the shaped objects, packaged in bulk in the front region of the dispensing device.

According to FIGS. 2 to 4, i.e. for a device with a single chute (17):

a crown segment (31), mounted on the guide means (29), which moves freely between the two planes (12) and (14) of the female part when the male part (2) rotates and which blocks, at least partially and at the end of its travel, the upstream opening in the chute (17), in the appropriate rotational direction of the male part.

According to FIGS. 5 to 7, i.e. for a device with two chutes (17) and (18):

a crown segment (31), mounted on the guide means (29) which moves freely between the two planes (12) and (14) of the female part when the male part (2) rotates and which blocks the upstream openings of the chutes (17) and (18), at least partially and alternately, at the end of its travel.

This crown segment (31) may be bevelled (32) at each of its ends (32), and this allows the bulk shaped objects to be agitated and guided singly towards the at least one chute (17) or (18) in which said objects are stacked in a queue.

According to FIGS. 5 to 7, i.e. for a device with two chutes (17) and (18):

a guide means (33) for the object to be dispensed placed in the axis of the opening (25) of the platform (23) which is able to release a shaped object, by providing the exit opening of the chute (17) whilst the exit of the other chute (18) is closed by the internal face of the base platform (23) and which, by reversing the direction of rotation, releases a shaped object through the exit opening of the chute (18), whilst the exit of the chute (17) is in turn closed by the internal surface of the base platform (23).

According to FIGS. 2 to 4, i.e. for a device with a single chute (17):

the same guide means (33) for the object to be dispensed placed in the axis of the opening (25) of the platform (23) which is able to release a shaped object, by providing the exit opening of the chute (17) and making it congruent with the opening (25) of the platform (23) and which, by reversing the direction of rotation, closes the exit opening of the chute (17).

Therefore, with every restricted rotation of the moving male part (2), a shaped object is dispensed by either of the chutes (17) and/or (18).

Figure 12:
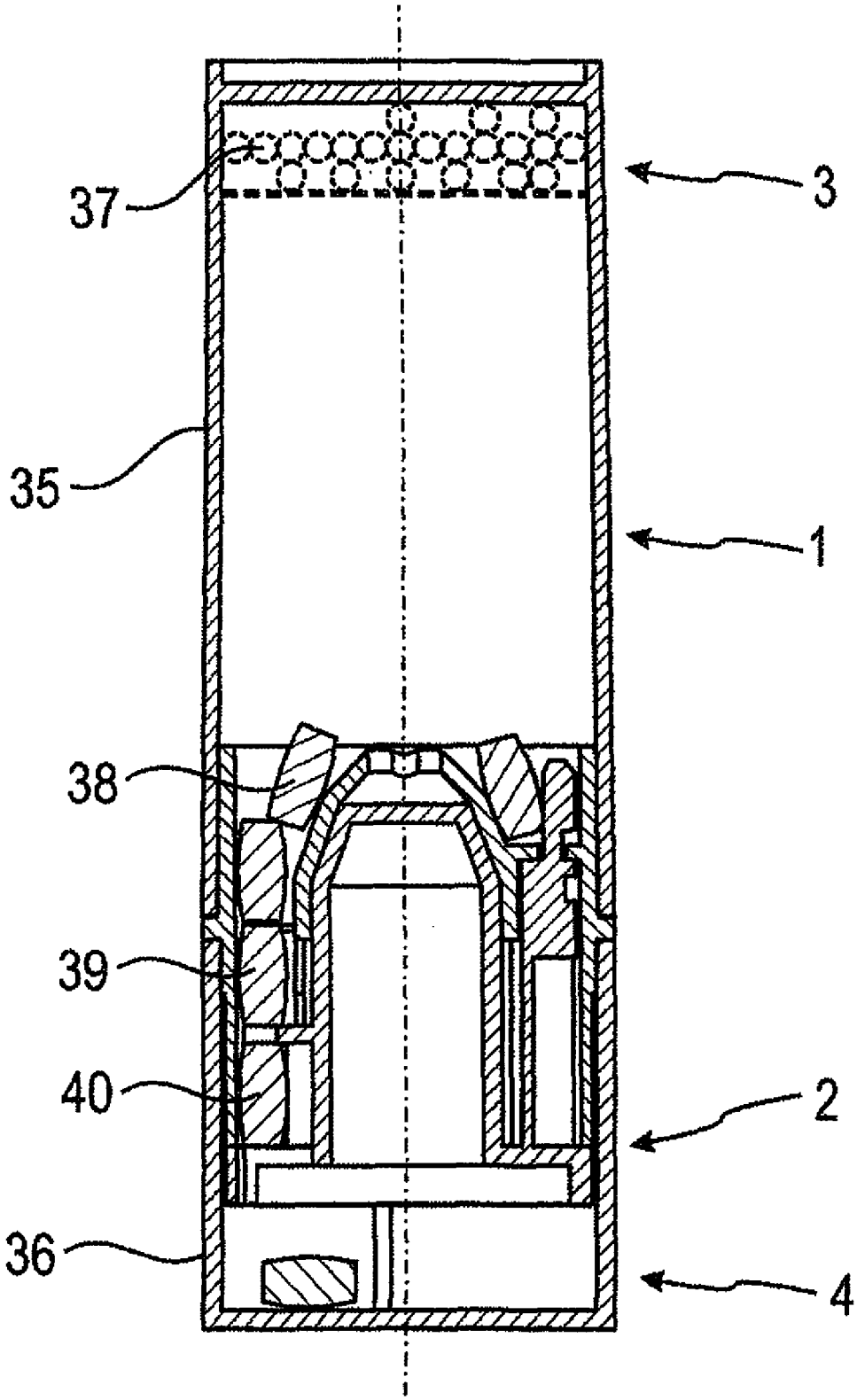
FIG. 12 is a section along the longitudinal axis of the closed unit for packaging and dispensing shaped objects singly including, in sequence, a tubular casing for bulk packaging of said objects, the device for dispensing said objects and the cap mounted on the male part of the dispensing device.

According to FIG. 12, which shows an axial section of the device for dispensing shaped objects singly with two chutes, said device is mounted on a container (35) and a cap (36), which constitutes a closed packaging unit, optionally for the treatment and dispensing singly of shaped objects to be dispensed, this unit comprising in the container (35) an internal recess means (37) for receiving the appropriate treatment agents in the form of a powdery mixture.

Finally, the mode of operation of the device for dispensing shaped objects singly according to the invention can be seen in FIGS. 1 to 12.

The shaped objects to be dispensed singly that are packaged in bulk in the container (35) are guided into the external casing (5) of the female part (1) and oriented by the cylindrical/truncated cone-shaped casing (8) in the free space (11), defined by these two coaxial casings, according to their position (38).

Placed between the two planes (12) and (14) in the shape of circular sectors with opposing angles $\alpha$ and $\beta$, the crown segment (31) with bevelled ends (32), rotated in either direction by the male part (2), agitates the bulk shaped objects and guides them singly towards the chutes (17) and (18) in which said objects (39) and (40) are stacked in a queue.

Once the guide means (33) for the object to be dispensed placed in the axis of the opening (25) of the platform (23) is congruent with the exit opening of the chute (17), a shaped object is released once the exit of the other chute (18) is closed by the internal surface of the base platform (23). By reversing the direction of rotation, a shaped object is released through the exit opening of the chute (18), whilst the exit of the chute (17) is closed by the internal surface of the base platform (23).

The invention claimed is:

1. A device for dispensing shaped objects singly, which objects to be dispensed singly are packaged in bulk, the device comprising a female part and a male part which mate coaxially with each other, wherein the female part is fixed and the male part is rotatable, wherein a) the fixed female part constitutes an upstream part for the bulk objects to enter into the device, and comprises:

a1) an external main cylindrical casing which is open at its upstream end and downstream end, a2) an internal casing, which is coaxial with the external casing, closed at its upstream part and open at its downstream part, of which the distance from the external casing is at least equal to the smallest dimension of the object to be dispensed to create a free space for the orientation and organized movement of said objects from upstream to downstream, a3) a first plane, which is close to the upstream end, connects the coaxial external casing and internal casing perpendicularly to said axis, is shaped as a circular sector of angle $\alpha$, is provided with an opening shaped as an arc of a circle, and leaves the free space for orientation and organized movement clear, a4) a second plane, which is placed between the first plane and the downstream end, connects the coaxial external casing and internal casing perpendicularly to the axis, is shaped as a circular sector of angle $\beta$, is provided with at least one opening dimensioned for the passage downstream singly of the objects present in the free space for orientation and organized movement, a5) between the second plane and the downstream end of the female part, at least one chute mounted on the at least one opening of the second plane, to allow storage in a queue of stacked objects to be dispensed which originate from the free space for orientation and organized movement, this at least one chute being delimited by the coaxial external casing and internal casing and by two planar lateral walls by a chute connecting said casings and extending to the downstream end of said female part, the at least one chute being provided at its downstream end with an opening dimensioned for the passage of a single object to be dispensed, and wherein b) the rotatable male part constitutes the downstream part for discharge of the dispensed objects from the device, and comprises:

b1) a base platform shaped as a circular disk which forms a stop for the external cylindrical casing of the female part, this platform being provided with an opening dimensioned for the passage of an object delivered by the at least one chute, b2) a casing coaxial with the base platform to which it is connected, having substantially the shape of the internal casing of the female part of the device, in which it inserts itself to allow the rotation of the male part relative to the female part of the device, b3) a means for guidance in rotation connected to and perpendicular to the base platform, the free end of which is designed to insert itself into the opening shaped as an arc of a circle of the first plane of the female part, b4) a crown segment, mounted on the means for guidance in rotation, which moves freely, when the male part of the device rotates, between the two planes of the female part of the device and which blocks the inlet opening of the at least one chute, at least partially and at the end of its travel, in at least one direction of rotation of the male part, and b5) a guide means for the object to be dispensed placed in the axis of the dimensioned opening of the base platform on the external wall of the casing coaxial with the platform of the male part, and wherein the rotatable mail part comprises a crown segment mounted on the guide means which, during the rotation of the male part, moves freely between the two planes of the female part and blocks the upstream opening of the chutes, at least partially and alternately at the end of its travel.

2. The device according to claim 1, wherein the external cylindrical casing is equipped on its external surface with a ring which is connected to said casing and acts as a stop.

3. The device according to claim 1, wherein the internal casing, coaxial with the first casing, has a geometry generated by revolution of a cylindrical, cylindrical/truncated cone shaped, cylindrical/conical, truncated cone shaped, conical or parabolic type.

4. The device according to claim 3 wherein the upstream part of the internal casing is of a truncated cone shaped, conical, hemispherical or parabolic type.

5. The device according to claim 1, wherein the free space created between the external casing and the internal casing reaches a minimum thickness in the most downstream part that is slightly greater than the smallest dimension of the object to be dispensed.

6. The device according to claim 1, wherein the angle $\alpha$, in degrees, at the top of the circular sector of the first plane, is a resultant of the diameters of the shaped objects to be dispensed and the female part.

7. The device according to claim 1, wherein the angle $\beta$, in degrees, at the top of the circular sector of the second plane, is a resultant of the diameters of the shaped objects to be dispensed and the female part.

8. The device according to claim 1, wherein the second circular sector of angle $\beta$ of the second plane occupies a position opposite the first circular sector of angle $\alpha$ of the first plane.

9. The device according to claim 1, wherein the sum of angles $\alpha$ and $\beta$ of the two circular sectors is at most 360 degrees.

10. The device according to claim 1, wherein the at least one opening has a section that is greater than the smallest section of the shaped objects to be dispensed but such that two shaped objects to be dispensed cannot pass through it.

11. The device according to claim 1, wherein at least one opening has a section that is slightly greater than the smallest section of said objects.

12. The device according to claim 1, wherein the planar lateral walls of the at least one chute are parallel to each other.

13. The device according to claim 1, wherein the planar lateral walls of the at least one chute are concurrent with each other from upstream to downstream of the at least one chute.

14. The device according to claim 1, wherein the device comprises two chutes.

15. The device according to claim 1, wherein the casing, coaxial with the base platform, has a geometry generated by revolution that is cylindrical, cylindrical/truncated cone shaped, cylindrical/conical, truncated cone shaped, conical or parabolic.

16. The device according to claim 1, wherein the ends of the crown segment mounted on the means for guidance in rotation are beveled.

17. The device according to claim 1, wherein the guide means mounted on the external wall of the casing coaxial with the platform has a semi-polygonal, semi-circular or semi-elliptical plane and further comprising a means for containing one or more agents for treating or removing ambient gaseous pollutant, and wherein the gaseous pollutant is water vapor and wherein the means for removing water vapor is in the form of an internal covering in the container and/or cap, of an insert placed inside the container and the cap, of the male part of the device, wherein the means is produced from a thermoplastic polymer composition containing a treatment agent.

18. The closed unit according to claim 17, wherein the treatment agent is selected from the group consisting of silica gels, molecular sieves and clays.

19. The device according to claim 18, wherein the free end of the means for guidance in rotation that emerges from the opening shaped as an arc of a circle acts as an agitator for the shaped objects, packaged in bulk in the packaging region.

20. The closed unit according to claim 17, wherein the one or more agents are used in a powdery or compacted form, and placed in a specific recess situated at the bottom of the container or the bottom of the cap.

21. The closed unit according to claim 17, wherein a gaseous pollutant in addition to water vapor is to be treated or removed, and at least a suitable treatment agent appropriate for treating the additional pollutant is included.

22. The closed unit according to claim 21, wherein the unit comprises one or more open compartments created in appropriate recess inside the unit, which recess is divided into sectors enabling a plurality of mutually compatible treatment agents or mixtures of treatment agents to be received separately.

23. A closed unit for packaging and dispensing shaped objects singly comprising the device according to claim 1, which device is connected and mounted by one of its ends on an open end of a bulk packaging container for the shaped objects to be dispensed, wherein the bulk packaging container is formed by a casing and a cap, and wherein the device is connected by the other of its ends to the cap, which cap is capable of rotating the moving male part of said device in either direction.

24. The closed unit according to claim 23, which is produced from a thermoplastic polymeric and/or copolymeric material selected from the group consisting of polyethylenes (PE), polypropylenes (PP), ethylene/propylene copolymers and mixtures thereof, polyamides (PA), polystyrenes (PS), acrylonitrile-butadiene-styrene copolymers (ABS), styrene acrylonitrile copolymers (SAN), polyvinylchorides (PVC), polycarbonates (PC), polymethyl methacrylate (PMMA), polyethyleneterephthalates (PET), used individually or mixed depending on their compatibility.

25. The closed unit according to claim 24, wherein added to the thermoplastic polymeric and/or copolymeric materials is at least one natural or synthetic thermoplastic elastomer, the thermoplastic elastomer(s) being elastomers of the natural rubber type or synthetic rubber type, or rubbers based on condensation products.

26. The closed unit according to claim 25, wherein the thermoplastic elastomer is selected from the group consisting of olefin-based rubbers, isobutylene/isoprene polymers, ethylene-vinyl acetate (EVA), ethylene-propylene (EPR), ethylene-propylene-diene (EPDM), ethylene-acrylic esters (EMA-EEA), fluoropolymers, diene rubbers, polybutadienes, butadiene-styrene copolymers (SBR), thermoplastic polyester, polyurethane rubbers, silicones, styrene rubbers, styrene-butadiene-styrene (SBS) and styrene-isoprene-styrene (SIS).

27. A device for dispensing shaped objects singly, which objects to be dispensed singly are packaged in bulk, the device comprising a female part and a male part which mate coaxially with each other, wherein the female part is fixed and the male part is rotatable, wherein a) the fixed female part constitutes an upstream part for the bulk objects to enter into the device, and comprises:

a1) an external main cylindrical casing which is open at its upstream end and downstream end, a2) an internal casing, which is coaxial with the external casing, closed at its upstream part and open at its downstream part, of which the distance from the external casing is at least equal to the smallest dimension of the object to be dispensed to create a free space for the orientation and organized movement of said objects from upstream to downstream, a3) a first plane, which is close to the upstream end, connects the coaxial external casing and internal casing perpendicularly to said axis, is shaped as a circular sector of angle $\alpha$, is provided with an opening shaped as an arc of a circle, and leaves the free space for orientation and organized movement clear, a4) a second plane, which is placed between the first plane and the downstream end, connects the coaxial external casing and internal casing perpendicularly to the axis, is shaped as a circular sector of angle $\beta$, is provided with at least one opening dimensioned for the passage downstream singly of the objects present in the free space for orientation and organized movement, a5) between the second plane and the downstream end of the female part, at least one chute mounted on the at least one opening of the second plane, to allow storage in a queue of stacked objects to be dispensed which originate from the free space for orientation and organized movement, this at least one chute being delimited by the coaxial external casing and internal casing and by two planar lateral walls by a chute connecting said casings and extending to the downstream end of said female part, the at least one chute being provided at its downstream end with an opening dimensioned for the passage of a single object to be dispensed, and wherein b) the rotatable male part constitutes the downstream part for discharge of the dispensed objects from the device, and comprises:

b1) a base platform shaped as a circular disk which forms a stop for the external cylindrical casing of the female part, this platform being provided with an opening dimensioned for the passage of an object delivered by the at least one chute, b2) a casing coaxial with the base platform to which it is connected, having substantially the shape of the internal casing of the female part of the device, in which it inserts itself to allow the rotation of the male part relative to the female part of the device, b3) a means for guidance in rotation connected to and perpendicular to the base platform, the free end of which is designed to insert itself into the opening shaped as an arc of a circle of the first plane of the female part, b4) a crown segment, mounted on the means for guidance in rotation, which moves freely, when the male part of the device rotates, between the two planes of the female part of the device and which blocks the inlet opening of the at least one chute, at least partially and at the end of its travel, in at least one direction of rotation of the male part, and b5) a guide means for the object to be dispensed placed in the axis of the dimensioned opening of the base platform on the external wall of the casing coaxial with the platform of the male part, and wherein the free end of the means for guidance in rotation, which moves in the opening shaped as an arc of a circle of the first plane of the female part, restricts the rotational angle in either direction by a stop at each end of said opening shaped as an arc of a circle for making the opening of the platform congruent with the downstream end of the at least one chute.

28. The device according to claim 27, wherein the rotational angle of the male part, from one end stop to the other end stop, has an angular value $\gamma$, delimited by two sides of an angle passing through the center of symmetry of each of two openings and wherein the second plane placed between the first plane and the downstream end, connecting the coaxial external casing and internal casing perpendicularly to said axis, in the shape of a circular sector of angle $\beta$, is provided with two openings dimensioned for the passage downstream singly of objects present in the free space for orientation and organized movement, these two openings being mutually spaced by an angle $\gamma$, and wherein the two openings in the second plane are mutually spaced by the angle $\gamma$, delimited by the two sides of said angle passing through the center of symmetry of each of these two openings, this angle $\gamma$ being chosen from the range of angular values of approximately 0° when the two openings are juxtaposed up to 180° when the openings are diametrically opposed, regardless of the direction of rotation of the male part.

29. The device according to claim 27, wherein the guide means mounted on the external wall of the casing coaxial with the platform has a semi-polygonal, semi-circular or semi-elliptical plane and further comprising a means for containing one or more agents for treating or removing ambient gaseous pollutant, and wherein the gaseous pollutant is water vapor and wherein the means for removing water vapor is in the form of an internal covering in the container and/or cap, of an insert placed inside the container and the cap, of the male part of the device, wherein the means is produced from a thermoplastic polymer composition containing a treatment agent.

30. The closed unit according to claim 29, wherein the treatment agent is selected from the group consisting of silica gels, molecular sieves and clays.

* * * * *